US005392622A

United States Patent [19]

O'Donnell

[11] Patent Number: 5,392,622

[45] Date of Patent: Feb. 28, 1995

[54] COMPOSITE HOLDERS FOR KEYS AND KNIVES

[76] Inventor: Robert F. O'Donnell, 70 Heritage Ln., Apt. B-5, Leominster, Mass. 01453

[21] Appl. No.: 162,219

[22] Filed: Dec. 6, 1993

[51] Int. Cl.[6] ..... A47G 29/10

[52] U.S. Cl. ..... 70/456 R; 7/118; 206/37.4

[58] Field of Search ..... 70/456 R; 24/3 K; D3/207, 208, 210; 206/37.1, 37.2, 37.3, 37.4; 7/118

[56] References Cited

U.S. PATENT DOCUMENTS

| | | | |
|---|---|---|---|
| 1,999,290 | 4/1935 | Goessling | 70/456 R |
| 2,248,436 | 7/1941 | Rivers | 70/456 R |
| 2,287,521 | 6/1942 | Handley | 70/456 R |
| 2,387,319 | 10/1945 | Evans | 70/456 R |
| 2,630,212 | 3/1953 | Mosch | 70/456 R X |
| 2,652,712 | 9/1953 | Hoag | 70/456 R |
| 2,795,128 | 6/1957 | Ly | 70/456 R |
| 2,822,684 | 2/1958 | Ray | 70/456 R |
| 4,253,321 | 3/1981 | Sorensen | 70/456 R |
| 4,660,397 | 4/1987 | Girimont | 70/456 R |
| 4,941,569 | 7/1990 | Lindmayer et al. | 70/456 R X |

FOREIGN PATENT DOCUMENTS

| | | | |
|---|---|---|---|
| 482277 | 4/1952 | Canada | 70/456 R |

*Primary Examiner*—Lloyd A. Gall

[57] ABSTRACT

A combination device for retaining a key and a knife having a primary base plate and a secondary base plate. Also included are a spacer plate, a pair of securement pins, a key, and a knife. The primary base plate, the secondary base plate, and the spacer plate are in a stacked orientation with the key and the knife secured between the aforementioned plates.

3 Claims, 3 Drawing Sheets

COMPOSITE HOLDERS FOR KEYS AND KNIVES

BACKGROUND OF THE INVENTION

1. Field of the Invention

The present invention relates to composite holders for keys and knives and more particularly pertains to holders for implements wherein the implements may pivot individually between a stored orientation and a deployed orientation.

2. Description of the Prior Art

The use of holders for knives and keys is known in the prior art. More specifically, holders for knives and keys heretofore devised and utilized for the purpose of carrying and using knives and keys are known to consist basically of familiar, expected, and obvious structural configurations, notwithstanding the myriad of designs encompassed by the crowded prior art which has been developed for the fulfillment of countless objectives and requirements.

The prior art discloses a large number of patents related to holders for keys and like items. By way of example, U.S. Pat. Nos. 4,379,394 to Toyoda and 4,637,238 to Uda disclose support devices for keys in which the key may be pivoted about an axis in the plane of the key in order to retract the key.

The pivoting of a key between an operative and inoperative orientation is also disclosed in U.S. Pat. Nos. 3,618,346 to Humphrey and 4,524,594 to Bascon. In these latter two patents the key is rotatable within the plane of the key.

In this respect, the composite holders for keys and knives according to the present invention substantially departs from the conventional concepts and designs of the prior art, and in doing so provides an apparatus primarily developed for the purpose of storing, carrying and using keys, knives and other implements.

Therefore, it can be appreciated that there exists a continuing need for new and improved composite holders for keys and knives which can be used for storing, carrying and using keys, knives and other implements. In this regard, the present invention substantially fulfills this need.

SUMMARY OF THE INVENTION

In view of the foregoing disadvantages inherent in the known types of holders for knives and keys now present in the prior art, the present invention provides improved composite holders for keys and knives. As such, the general purpose of the present invention, which will be described subsequently in greater detail, is to provide a new and improved composite holders for keys and knives and method which has all the advantages of the prior art and none of the disadvantages.

To attain this, the present invention essentially comprises a new and improved combination holder device for retaining keys, knives and other implements comprising, in combination, a primary base plate; a secondary base plate, the primary and secondary base plates being of a similar construction and including a rectangular inboard section having long side edges and one short inboard end edge with a longitudinal axis parallel with the side edges and through the center of the inboard end edge, each plate also having a trapezoid shaped outboard section with a short parallel free edge and a long parallel edge formed integrally with the edge of the rectangular section opposite from the short inboard edge and with tapering side edges therebetween, each of the plates also having a pair of aligned securement holes therethrough spaced along the longitudinal axis adjacent to the free edge and long parallel edge, and a pair of pivot holes located lateral from the longitudinal axis within the trapezoid shaped section; a spacer plate in a rectangular configuration with parallel side edges spaced from the parallel edges of the base plates proximate to the longitudinal axis and with a free edge in alignment with the free edge of the plates and with a pair of holes positionable in alignment with the holes of the rectangular section to thereby define storage zones between the rectangular sections and pivot zones between the trapezoid sections; a pair of securement pins positioned through the two plate members with the spacer member therebetween for permanent coupling and a pair of pivot pins extending through the holes of the plates of the trapezoid sections; a key having an operative outboard end and an inboard end with a hole, the hole and the inboard end being positioned between the plates with the pivot pin extending through the plates and the hole of the key therebetween, the key being rotatable between an operative deployed orientation exterior of the plates along the length of the axis and an inoperative stored orientation wherein the key is pivoted into the storage space; a knife having an operative outboard end and an inboard end with a hole, the hole and the inboard end being positioned between the plates with the pivot pin extending through the plates and the hole of the knife therebetween, the knife being rotatable between an operative deployed position exterior of the plates along the length of the axis and an inoperative stored orientation wherein the knife is pivoted into the storage space; and a plurality of plates in a stacked orientation with a plurality of spacer plates between each of the base plates and with a pair of implements secured between the plurality plates in the plane of the intermediate plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved composite holders for keys and knives which have all the advantages of the prior art holders for knives and keys and none of the disadvantages.

It is another object of the present invention to provide new and improved composite holders for keys and knives which may be easily and efficiently manufactured and marketed.

It is a further object of the present invention to provide new and improved composite holders for keys and knives which are of durable and reliable constructions.

An even further object of the present invention is to provide new and improved composite holders for keys and knives which are susceptible of a low cost of manufacture with regard to both materials and labor, and which accordingly are then susceptible of low prices of sale to the consuming public, thereby making such composite holders for keys and knives economically available to the buying public.

Still yet another object of the present invention is to provide new and improved composite holders for keys and knives which provide in the apparatuses and methods of the prior art some of the advantages thereof, while simultaneously overcoming some of the disadvantages normally associated therewith.

Lastly, it is an object of the present invention to provide a combination device for retaining keys, a knife and other articles comprising a primary base plate; a secondary base plate, the primary and secondary base plates being of a similar construction and including a rectangular inboard section having long side edges and one short inboard end edge with a longitudinal axis parallel with the side edges and through the center of the inboard end edge, each plate also having a trapezoid shaped outboard section with a short parallel free edge and a long parallel edge formed integrally with the edge of the rectangular section opposite from the short inboard edge and with tapering side edges therebetween, each of the plates also having a pair of aligned securement holes therethrough spaced along the longitudinal axis adjacent to the free edge and long parallel edge, and a pair of pivot holes located lateral from the longitudinal axis within the trapezoid shaped section; a spacer plate in a rectangular configuration with parallel side edges spaced from the parallel edges of the base plates proximate to the longitudinal axis and with a free edge in alignment with the free edge of the plates and with a pair of holes positionable in alignment with the holes of the rectangular section to thereby define storage zones between the rectangular sections and pivot zones between the trapezoid sections; a pair of securement pins positioned through the two plate members with the spacer member therebetween for permanent coupling and a pair of pivot pins extending through the holes of the plates of the trapezoid sections; a key having an operative outboard end and an inboard end with a hole, the hole and the inboard end being positioned between the plates with the pivot pin extending through the plates and the hole of the key therebetween, the key being rotatable between an operative deployed orientation exterior of the plates along the length of the axis and an inoperative stored orientation wherein the key is pivoted into the storage space; a knife having an operative outboard end and an inboard end with a hole, the hole and the inboard end being positioned between the plates with the pivot pin extending through the plates and the hole of the knife therebetween, the knife being rotatable between an operative deployed position exterior of the plates along the length of the axis and an inoperative stored orientation wherein the knife is pivoted into the storage space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
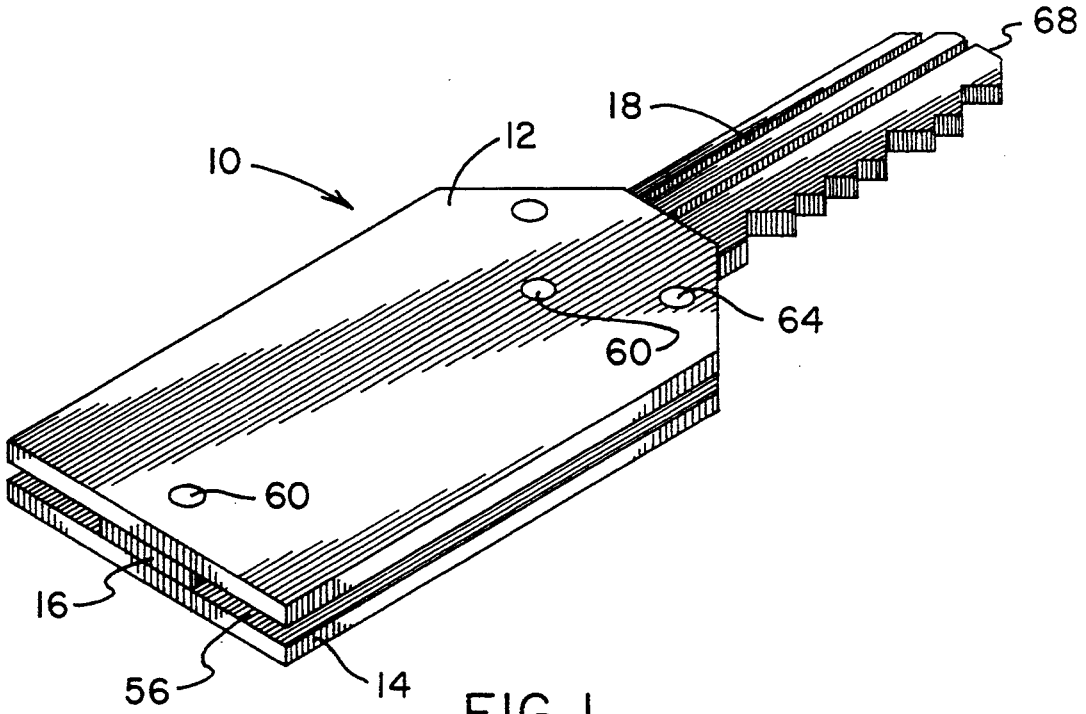
FIG. 1 is a perspective illustration of the preferred embodiment of the composite holders for keys and knives constructed in accordance with the present invention.

With reference now to the drawings, and in particular to FIG. 1 thereof, the preferred embodiment of the new and improved composite holders for keys and knives embodying the principles and concepts of the present invention and generally designated by the reference numeral 10 will be described.

More specifically, it will be noted in FIGS. 1 through 4 there is shown a combination holder device 10 for retaining keys, knives and other articles and implements. The device 10 comprises, in its broadest of terms, a pair of base plates 12 and 14, a spacer plate 16 therebetween and coupling pins therebetween, all for pivotally supporting a key 18, knife 20 and other articles and implements between a stored orientation and a deployed orientation. More specifically, the device includes a primary base plate 12 and a secondary base plate 14. The primary and secondary base plates are of a similar construction. Each includes a rectangular inboard section 24 having long side edges 26 and one short inboard end edge 28 with a longitudinal axis parallel with the side edges and through the center of the inboard end edge. Each plate also has a trapezoid shaped outboard section 32. Such section has a short parallel free edge 34 and a long parallel edge 36 formed integrally with the edge of the rectangular section opposite from the short inboard edge. Tapering side edges 38 are formed therebetween. Each of the plates also having a pair of aligned securement holes 42 therethrough spaced along the longitudinal axis. Such holes 42 are located adjacent to the free edge 28 and long parallel edge 36. In addition, a pair of pivot holes 46 are located lateral from the longitudinal axis within the trapezoid shaped section 32.

The next major component is the spacer plate 16. Such plate is formed in a rectangular configuration with parallel side edges 50 spaced inwardly from the parallel edges 26 of the base plates and is proximate to the longitudinal axis. The spacer plate 16 has a free edge 52 in alignment with the free edges 28 of the plates. It also has a pair of holes 54 positionable in alignment with the holes 42 of the rectangular section. As such there are defined storage zones 56 for knives, keys, etc. between the rectangular sections 24 and pivot zones between the trapezoid sections 32.

A pair of securement pins 60 are positioned through the two plate members with the spacer member therebetween. This effects a permanent coupling. In addition, pair of pivot pins 64 extend through the holes 46 of the plates of the trapezoid sections.

Figure 2:
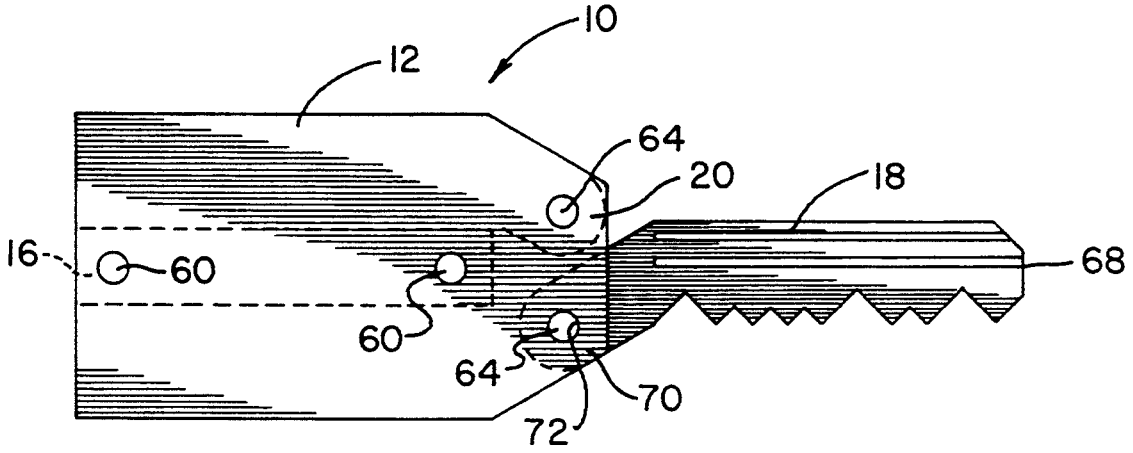
FIG. 2 is a plan view of the composite holder device illustrated in FIG. 1.
Figure 3:
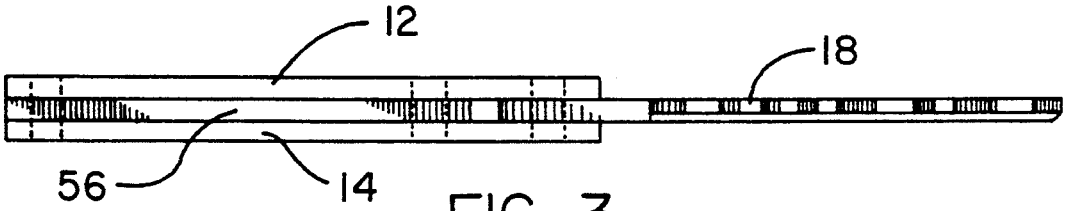
FIG. 3 is a side elevational view of the composite holder device shown in FIG. 2.
Figure 4:
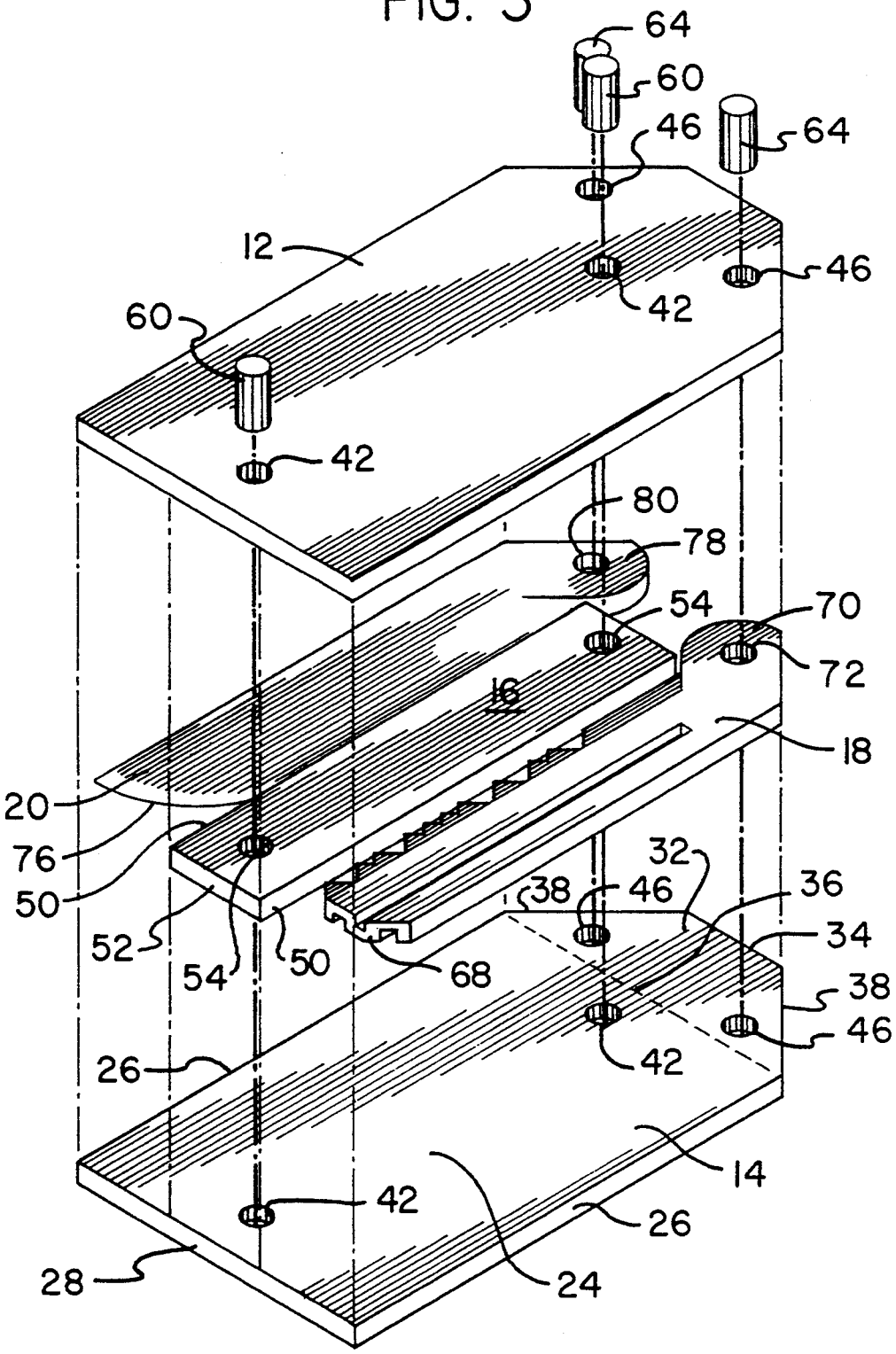
FIG. 4 is an exploded perspective illustration of the composite holder device shown in the prior Figure.

Next provided is a key 18. Such key has an operative outboard end 68 and an inboard end 70 with a hole 72. The hole and the inboard end are positioned between the plates with the pivot pin 64 extending through the plates with the hole of the key therebetween. The key is rotatable between an operative deployed orientation exterior of the plates along the length of the axis as shown in FIGS. 1, 2 and 3 and an inoperative stored orientation wherein the key is pivoted into the storage space as shown in FIG. 4.

Also provided is a knife 20. The knife has an operative outboard end 76 and an inboard end 78 with a hole 80. The hole 80 and the inboard end are positioned between the plates with the pivot pin 64 extending through the plates and the hole of the knife therebetween. The knife is rotatable between an operative deployed position exterior of the plates along the length of the axis and an inoperative stored orientation wherein the knife is pivoted into the storage space.

Figure 5:
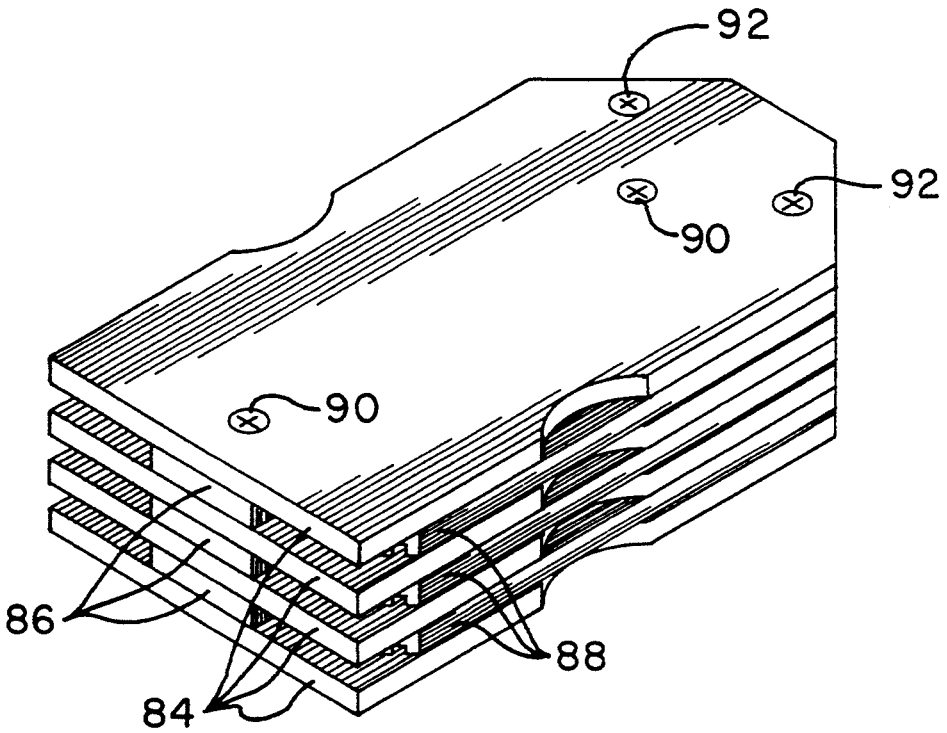
FIG. 5 is an illustration of an alternate embodiment of the composite holder for keys and knives.
Figure 6:
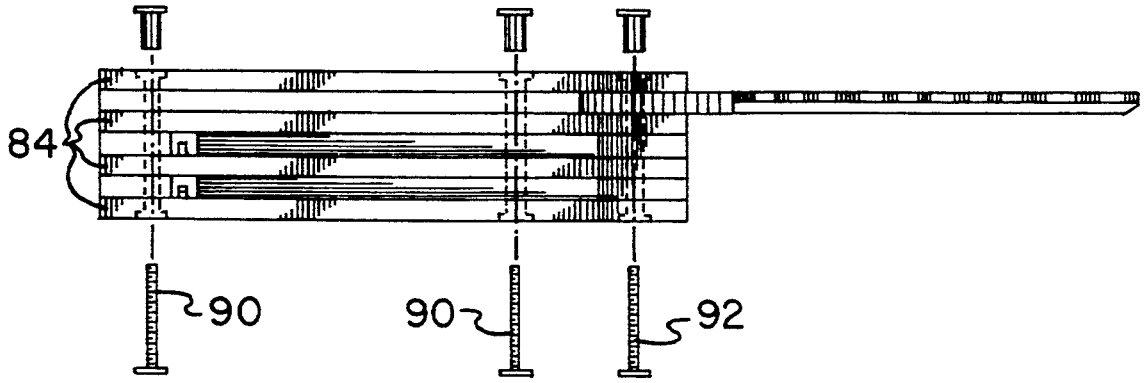
FIG. 6 is a side elevational view of the composite holder device of FIG. 5 with parts exploded away therefrom to illustrate certain internal construction.

An alternate embodiment of the invention is shown in FIGS. 5 and 6. According to such alternate embodiment, a plurality of base plates 84 are provided, four in the disclosed embodiment. Such plates are in a stacked orientation. A plurality of spacer plates 86 are located between each of the base plates 84. A pair of implements 88 are secured between each adjacent pair of base plates in the plane of the intermediate plate. The plates are configured as in the prior embodiments with securement pins 90 and pivot pins 92 formed and functioning also as in the prior embodiment but for receiving a larger number of keys, knives and other articles and implements. Lastly, the pins 90 and 92 of this embodiment are formed as bolts with sleeve nuts. This allows a user to change a knife and/or key. Such features is also applicable to the prior embodiment.

One of the handiest things to have in a purse or pocket is a small pocketknife. One of the most necessary items to keep there is a house, apartment or car key. However, with all the handy and necessary items that anyone could carry, a pocket or purse soon becomes cluttered and heavy. The present invention is a product that allows the owner to combine handy and necessary items in one small, compact and easy to carry unit.

The present invention is a combination key and pocket knife case made from either brass or steel. It consists of two end plates stamped out of sheet metal, a small, pocket knife-size knife blade, and two key blanks of the type which are available at any hardware store. They key blanks are rounded at one end, and holes are drilled in the rounded end so they can be attached to the end plates. A small, stationary piece of metal is attached to the end plates down the center so that the keys do not get pushed in too far to be pulled out and so that they don't pull out too far. The small knife blade and the keys are sandwiched between the two end plates.

The capacity of the present invention can also be expanded. The number of keys it will hold can be increased by adding additional layers consisting of another center stationary piece of metal and rounded and drilled key blanks on top of the existing ones and between the end plates.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved combination holder device for retaining keys and knives comprising, in combination:

a primary base plate;

a secondary base plate, the primary and secondary base plates being of a similar construction and including a rectangular inboard section having long side edges and one short inboard end edge with a longitudinal axis parallel with the side edges and through the center of the inboard end edge, each plate also having a trapezoid shaped outboard section with a short parallel free edge and a long parallel edge formed integrally with the edge of the rectangular section opposite from the short inboard edge and with tapering side edges therebetween, each of the plates also having a pair of aligned securement holes therethrough spaced along the longitudinal axis, one of which is, adjacent to the inboard end edge, and the other of which is adjacent to the long parallel edge, and a pair of pivot holes located lateral of the longitudinal axis within the trapezoid shaped section;

a spacer plate in a rectangular configuration with parallel side edges spaced from the long side edges of the base plates proximate to the longitudinal axis and with a free edge in alignment with the inboard end edge of the plates and with a pair of holes positionable in alignment with the aligned securement holes of the rectangular section to thereby define storage zones between the rectangular inboard sections and the pivot holes of the trapezoid sections;

a pair of securement pins positioned through the primary base plate and the secondary base plate with the spacer plate therebetween for permanent coupling and a pair of pivot pins extending through the holes of the trapezoid sections;

a key having an operative outboard end and an inboard end with a hole, the hole and the inboard end being positioned between the plates with a pivot pin extending through the plates and the hole of the key therebetween, the key being rotatable between an operative deployed orientation exterior of the plates along the length of the axis and an inoperative stared orientation wherein the key is pivoted into a storage zone;

a knife having an operative outboard end and an inboard end with a hole, the hole and the inboard end being positioned between the plates with a pivot pin extending through the plates and the hole of the knife therebetween, the knife being rotatable between an operative deployed position exterior of the plates along the length of the axis and an inoperative stored orientation wherein the knife is pivoted into a storage zone; and a plurality of primary base plates and secondary base plates in a stacked orientation with a plurality of spacer plates between each of the base plates and with a key and knife secured between the plurality of base plates in the plane of a spacer plate.

2. A combination device for retaining keys and knives comprising:

a primary base plate;

a secondary base plate, the primary and secondary base plates being of a similar construction and including a rectangular inboard section having long side edges and one short inboard end edge with a longitudinal axis parallel with the side edges and through the center of the inboard end edge, each plate also having a trapezoid shaped outboard section with a short parallel free edge and a long parallel edge formed integrally with the edge of the rectangular section opposite from the short inboard edge and with tapering side edges therebetween, each of the plates also having a pair of aligned securement holes therethrough spaced along the longitudinal axis, one of which is, adjacent to the inboard end edge, and the other of which is adjacent to the long parallel edge, and a pair of pivot holes located lateral of the longitudinal axis within the trapezoid shaped section;

a spacer plate in a rectangular configuration with parallel side edges spaced from the long side edges of the base plates proximate to the longitudinal axis and with a free edge in alignment with the inboard end edge of the plates and with a pair of holes positionable in alignment with the aligned securement holes of the rectangular section to thereby define storage zones between the rectangular inboard sections and the pivot holes of the trapezoid sections;

a pair of securement pins positioned through the primary base plate and the secondary base plate with the spacer plate therebetween for permanent coupling and a pair of pivot pins extending through the holes of the trapezoid sections;

a first article having an operative outboard end and an inboard end with a hole, the hole and the inboard end being positioned between the plates with a pivot pin extending through the plates and the hole of the first article therebetween, the first article being rotatable between an operative deployed orientation exterior of the plates along the length of the axis and an inoperative stared orientation wherein the first article is pivoted into a storage zone;

a second article having an operative outboard end and an inboard end with a hole, the hole and the inboard end being positioned between the plates with a pivot pin extending through the plates and the hole of the second article therebetween, the second article being rotatable between an operative deployed position exterior of the plates along the length of the axis and an inoperative stored orientation wherein the second article is pivoted into a storage zone.

3. The device as set forth in claim 2 wherein there is provided a plurality of primary base plates and secondary base plates in a stacked orientation with a plurality of spacer plates between each of the base plates and with a key and knife secured between the plurality of base plates in the plane of a spacer plate.

* * * * *